United States Patent [19]

Goldberg

[11] Patent Number: 5,045,099

[45] Date of Patent: Sep. 3, 1991

[54] VACUUM CLEANER BAG INCLUDING COLLAR SEALING CLOSURE DEVICE

[75] Inventor: Harry Goldberg, Monsey, N.Y.

[73] Assignee: Mastercraft Industries, Inc., Newburgh, N.Y.

[21] Appl. No.: 411,859

[22] Filed: Sep. 25, 1989

[51] Int. Cl.[5] ..... B01D 46/02

[52] U.S. Cl. ..... 55/367

[58] Field of Search ..... 55/367

[56] References Cited

U.S. PATENT DOCUMENTS

| | | | |
|---|---|---|---|
| 2,070,674 | 2/1937 | Muentenere | 55/367 |
| 2,686,330 | 8/1954 | Wales | 55/367 |
| 3,237,846 | 3/1966 | Brown | 55/367 |
| 3,933,541 | 1/1976 | Johansson | 55/367 |

*Primary Examiner*—Bernard Nozick

*Attorney, Agent, or Firm*—Lilling and Lilling

[57] ABSTRACT

A vacuum cleaner bag is described which has a sealing closure device for an inlet opening in a collar of the vacuum cleaner bag. A disc, partially die-cut out of the collar or a separate disc attached to the collar is arranged for hinged movements between a covering position wherein the inlet opening is effectively closed and sealed and and uncovering position wherein the inlet opening is accessible for passage of an inlet fitting of a vacuum cleaner. A locking mechanism is provided for positively locking the hinged cover to disc in its covering position to prevent inadvertent escape of debris from a filled vacuum cleaner bag after removal from the vacuum cleaner. The locking mechanism may consist of a projecting finger on the disc or cover which is forced beyond the inlet opening and snaps behind the collar, or the projecting finger may be secured with any suitable fastener, such as hook and loop tape.

11 Claims, 2 Drawing Sheets

FIG.4
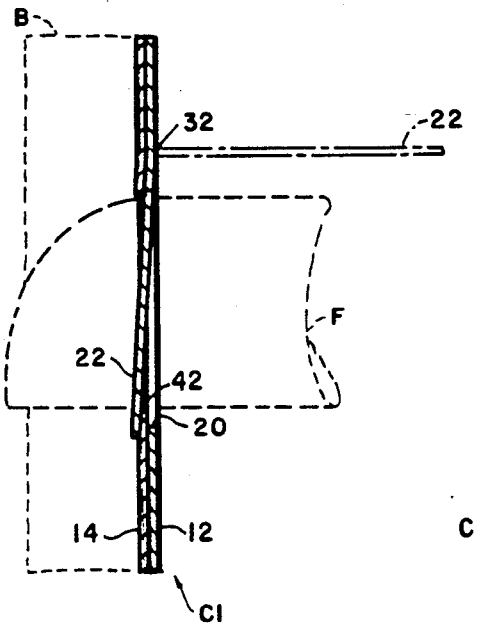
FIG.5
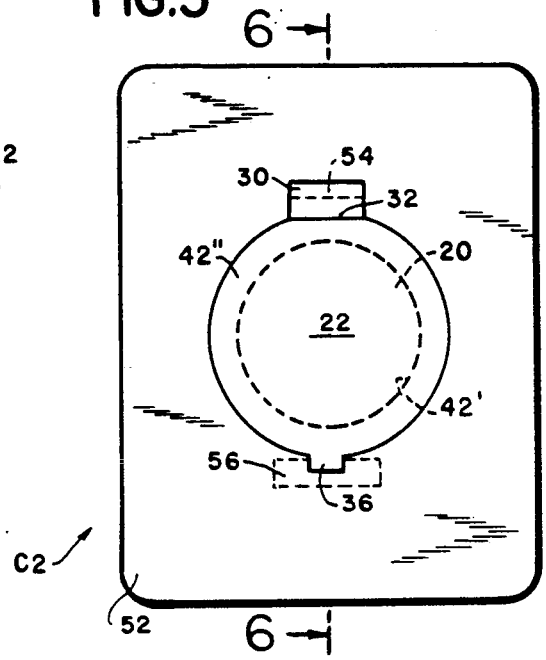
FIG.6
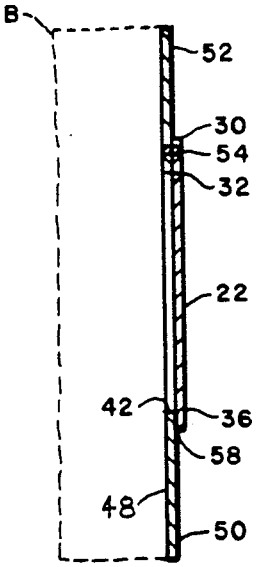
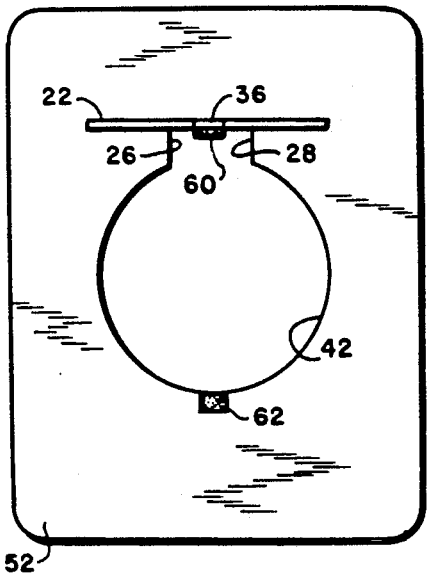
FIG.7

VACUUM CLEANER BAG INCLUDING COLLAR SEALING CLOSURE DEVICE

BACKGROUND OF THE INVENTION

1. Field of the Invention

This invention generally relates to vacuum cleaner bags, and more specifically to a vacuum cleaner bag construction which includes a collar sealing closure device for selectively and effectively sealing the inlet opening to the bag.

2. Description of the Prior Art

Filter bags require an inlet opening which is dimensioned to accept the inlet fitting of the vacuum cleaner bag through which contaminated air is guided into the vacuum cleaner bag. Efforts have been made to seal the inlet opening both during use, to avoid leakage and insure that all the debris is guided into the bag, and subsequently to avoid backflow or spillage during handling after the bag is removed from the vacuum cleaner. In one common design, a tongue is attached to a rigid or semirigid collar of the vacuum cleaner bag across the inlet opening. The collar is typically made of cardboard (for dispensable bags), or from a more durable material, such as stiff rubber or fiber (for reusable filter bags). However, such tongues must be used in connection with a rubber membrane incorporated into the collar. The tongue is forced through the inlet opening and only partially blocks the inlet opening because of the imperfect seal created by the rubber membrane when it contracts about the tongue. This problem also manifests itself when the bag is removed for replacement and must be handled in the course of being discarded or handled while emptying the contents so that the bag can be reused. Once the filter bag is filled with dust and debris, any pressures applied to the bag during handling creates a problem of a back flow of air which is forced through the imperfect seal above described.

Use of the tongue also has the disadvantage that it creates leakage during use of the bag in a vacuum cleaner when the tongue is lifted away from the inlet opening by the fitting to bear against the rubber membrane and thereby stretch the same. Because the fitting is generally cylindrical and the tongue is generally flat, spaces are created in the transition areas where the membrane moves from the tongue to the fitting. Such leakage releases potentially harmful materials into the bag chamber and draws debris into the motor where sub-atmospheric pressures are created thereby damaging, over extended periods of time, the motor and other operative parts. Numerous design examples of vacuum cleaner bags using such tongues are more fully discussed in co-pending application Ser. No. 07/329,360, filed on Mar. 27, 1989, and assigned to the assignee of the subject application. In all cases, however, the tongue cannot be positively locked after the bag is removed, thereby providing unreliable sealing that may vary from bag to bag.

The above-mentioned designs are particularly objectionable when the collected dust may be contaminated with germs (hotels, hospitals, etc.) or consists of hazardous materials (e.g. asbestos).

SUMMARY OF THE INVENTION

In order to overcome the aforementioned problems inherent in existing vacuum bag designs, it is an object of the present invention to provide a vacuum cleaner bag with an effective sealing closure device for covering and closing the inlet opening in the collar of the vacuum cleaner bag when same is removed from the vacuum cleaner inlet fitting.

It is another object of the present invention to provide a vacuum cleaner bag of the type under discussion which is simple in construction and economical to manufacture.

It is still another object of the present invention to provide a vacuum cleaner bag as in the previous objects which eliminates the need for a conventional tongue or which extends through the inlet opening of the bag during use, thereby avoiding back flow of debris and contaminated air.

It is yet another object of the present invention which permits convenient and safe handling of vacuum cleaner bags which may be filled with hazardous materials.

In order to achieve the above objects, as well as others which will become apparent hereafter, a vacuum cleaner bag in accordance with the present invention comprises a collar made of rigid or semi-rigid material defining inner and outer surfaces and having an inlet opening of pre-determined configuration. The collar is attached to the bag. Cover means are provided having a shape substantially corresponding to said pre-determined configuration, said cover means being hingedly mounted for movement between an exposing position in a direction spaced from said outer surface for uncovering said inlet opening and a covering position substantially covering said inlet opening. Locking means are provided for positively locking said cover means in said covering position. In this manner, said cover means may be maintained in said covering position after the filled vacuum cleaner bag is removed from a vacuum cleaner thereby preventing debris from escaping from said inlet opening.

The invention is simple in design and provides an effective mechanism for covering the inlet opening, thus entrapping dust within the bag and preventing back flow of contaminated air from inside the bag through the inlet opening and thereby avoiding undesirable exposure to those handling the vacuum cleaner bag to hazardous materials.

In one simple form, the cover means comprises a disc partially die cut in said collar, the uncut region forming a hinge for the disc which otherwise, if completely die cut, would permit the disc to separate from the collar. The hinged disc is provided with a projecting finger opposite the hinged region so that the disc can be swung outwardly from the inlet opening to clear the inlet opening so that the bag can be connected to a vacuum cleaner inlet fitting in the usual manner. When the bag is disconnected from the cleaner, the hinged disc can be repositioned to cover the inlet opening, and when pushed through the inlet opening, the projecting finger snaps behind the collar to provide a positive locking of the disc thereby effectively covering and closing the inlet opening and preventing debris within the vacuum cleaner bag from inadvertently escaping.

BRIEF DESCRIPTION OF THE DRAWINGS

Preferred embodiments of the invention will now be described by way of example with reference to the accompanying drawings, in which:

FIG. 4 is a cross-sectional view of the collar shown in FIG. 2, taken along line 4—4 and showing the covering disc in its locked position as well as showing the disc (in phantom outline) when the bag is in use in a vacuum cleaner;

FIG. 5 is a front elevational view of a modified collar design in accordance with the present invention;

FIG. 6 is a cross-sectional view of the modified collar of FIG. 5, taken along lines 6—6, showing the covering disc in a position covering the inlet opening; and FIG. 7 is similar to FIG. 5, but showing the disc hinged upwardly to its uncovering position as when used in a vacuum cleaner.

DESCRIPTION OF THE PREFERRED EMBODIMENTS

Figure 1:
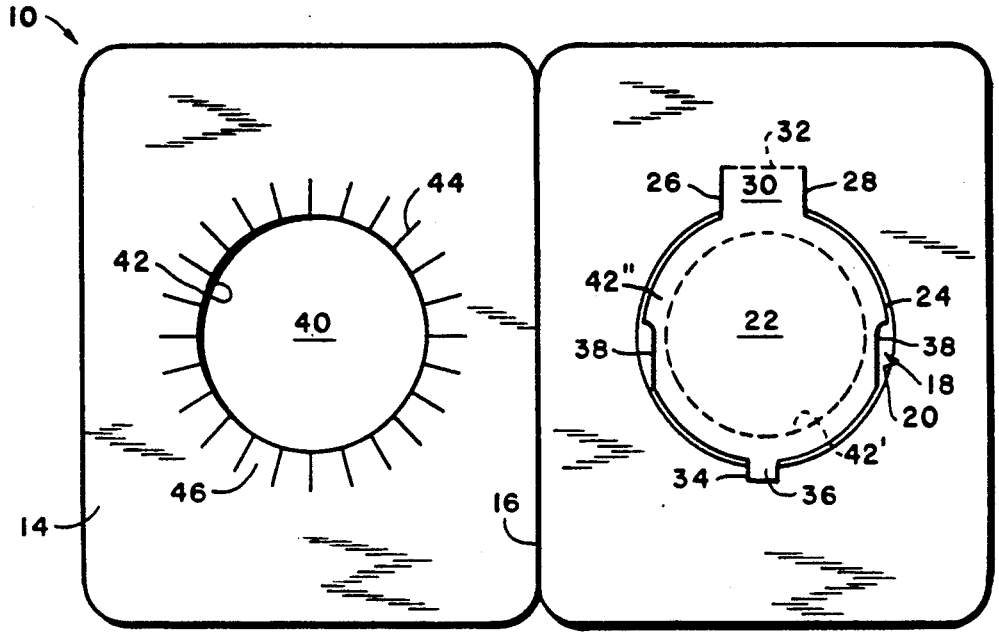
FIG. 1 is a top plan view of a blank which can be used to form a collar for a vacuum cleaner bag in accordance with the present invention.

Referring now specifically to the Figures, wherein identical or similar parts are designated by the same reference numerals throughout, and first referring to FIG. 1, a blank 10 in FIG. 1 is preferably formed of a rigid or semi-rigid material, such as cardboard, although the specific material from which the blank is formed is not critical for the purposes of the present invention.

The blank 10, in a first embodiment shown in FIG. 1, is formed of equally sized outer and inner panels 12, 14 joined to each other at a score line 16 as shown. As can best be seen in FIGS. 2 and, 3, the panels 12, 14 can be folded about the score line 16 to be conjuxtaposed in aligned relationship so as to be co-extensive with each other.

The outer panel 12 is die cut to create a generally central circular opening 18 defined by a circular inner edge 20 and a generally circular disc 22 defined by an outer edge 24. While the edges 20,24 are substantially circular, the circular contours are modified as will now be described. Along the upper periphery of the circular edge 20, as viewed in FIG. 1, there are provided die cut spaced parallel lines 26, 28 to form a hinge strip 30, one end of which is attached to the outer panel 12 at a score line 32, while the other end of the hinge strip 30 is integrally connected with the disc 22. Similarly, a substantially rectangular die cut region 34 is formed at the diametrically opposite side of the disc 22 along the circular edge 20 to form a projecting tab or finger 36 integrally formed with the disc 22.

By the nature of the die cut operation, the spacing or clearance between the edges 20 and 24 of the opening 18 and the disc 22, respectively, is typically small. There is advantageously, therefore, provided at least one cut out 38 within the periphery of the disc 22 which facilitates insertion of a finger for the purpose of gripping the disc 22 and extracting same from the opening 18 when the disc is disposed in the plane of the outer panel 12.

The inner panel 14 is provided with a circular inlet opening 40, the diameter of which is smaller than the diameter of the opening 18, so that the circular edge 42 of the inlet opening 40 is spaced radially inwardly from the periphery of the inner circular edge 20, as suggested by the outline 42' in FIG. 1. This creates an annular disc abutment zone 42" which contacts the disc 22 when the same is received within the plane of the outer panel 12 and forced against inner panel 14. It will be noted in this connection, that the cutouts 38 do not project radially inwardly beyond the outline 42' so that contact is maintained between the disc 22 and the disc abutment zone 42" of the inner panel 14 about the entire circular periphery to assure sealing action over the entire area of the opening 40.

Figure 2:
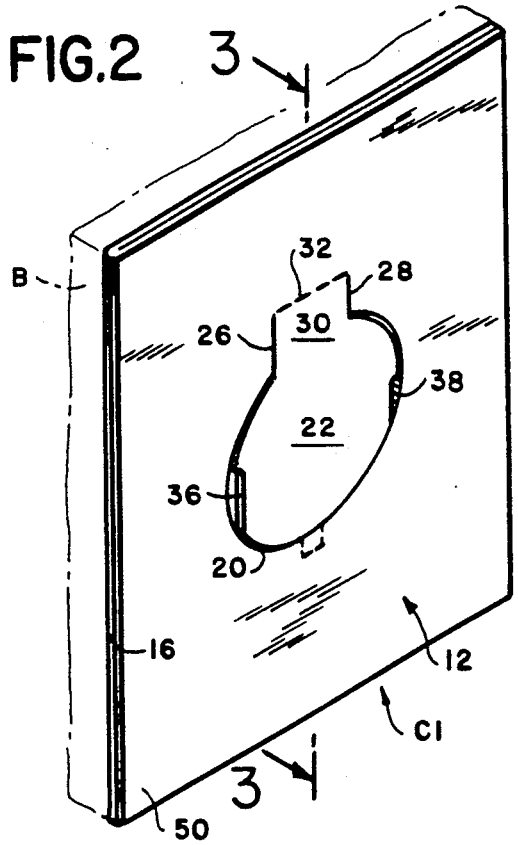
FIG. 2 is a perspective view of a collar of a vacuum cleaner bag made from the blank shown in FIG. 1, as viewed from the outer surface of the collar and showing the covering disc in its locked covering position.
Figure 3:
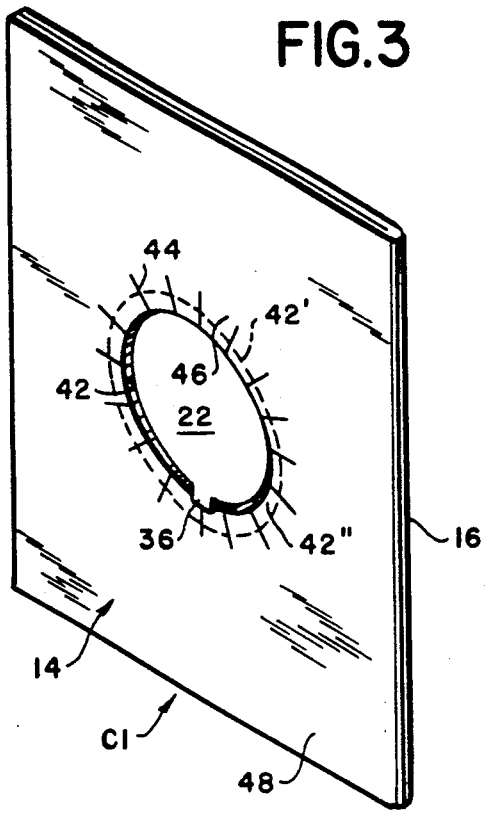
FIG. 3 is similar to FIG. 2, but showing the collar from its reverse or inner side.

Referring to FIGS. 1 and 3, the inner panel 14 is advantageously provided with optional radial slits 44 which are substantially equally spaced to provide equally sized radial tabs 46 which can be resiliently flexed to selectively enlarge the diameter of the circular opening 40 for facilitating introduction of a vacuum inlet fitting F (FIG. 4) through the opening 40. The vacuum cleaner bag B, shown in phantom outline in FIG. 2, is attached to the collar C1 in any conventional manner at the inner surface 48.

In use, the outer and inner panels 12, 14 are folded about the score line 16 and attached to each other, such as by adhesive or any other suitable and conventional method. The bag B is, at this time, secured to the collar C1. When the collar C1 is ready to be attached to the vacuum cleaner, the hinged disc 22 is lifted, such as by inserting one's fingers into the regions of the cutouts 38, gripping the hinged disc 22 and lifting same for hinged movement about the score line 32. During this process, the hinge strip 30 as well as the projecting tab or finger 36 are lifted out of the plane of the outer panel 12. It will be appreciated that the hinged disc is thereby mounted for movement between an uncovering or exposing position, in a direction spaced from the outer surface 50 for uncovering the inlet opening 40 and a sealing or covering position, as shown in FIGS. 1-3, wherein the hinged disc substantially covers and seals the inlet opening 40.

The projecting finger or tab 36 forms part of a locking mechanism for positively locking the hinged disc 22 in the covering or closed sealing position, as will be more fully described below, so that the hinged disc may be maintained in the covering or closed position after the filled vacuum cleaner bag is removed from a vacuum cleaner, thereby preventing debris from escaping from the inlet opening 40.

In the closed position, the hinged disc abuts against a substantial uniform width annular exposed disc abutment zone 42" to provide an effective seal, particularly when the hinged disc 22 is positively locked as shown in FIGS. 2 and 3. In the form shown in FIGS. 1-3, the projecting finger 36 radially extends from the hinged disc 22 beyond the periphery of the inlet opening 40, the finger 36 being sufficiently flexible to permit the finger to be force snapped behind the inner panel 14 for interlocking abutment against the inner surface 48 of the inner panel 14.

While the hinged disc 22 can be mounted for movement in a number of different ways, in the construction shown in FIGS. 1-3, such movement is provided by the hinge strip 30 which is hingedly mounted about a transverse straight score line 32 as shown in FIGS. 1 and 2.

After the vacuum cleaner bag has been filled, therefore, the collar C1 is removed from the vacuum cleaner inlet fitting, and the hinged disc 22 is returned to its initial position within the plane of the outer panel 12, the projecting finger 36 being force snapped behind the inner panel 14 so that it projects beyond the circular edge 42 and comes into abutting contact against the inner surface 48 as best shown in FIG. 3. In FIG. 4, the circular disc is shown in both its locked or covering position as well as its exposing position, in phantom outline. FIG. 4 also shows the inlet fitting F, in phantom outline, as it would be received through the collar C1 during use in a vacuum cleaner, in which case the disc would be hinged clear of the inlet opening as suggested by the further outline of the disc 22.

Referring to FIG. 5, another embodiment of a collar C2 is shown wherein the collar is formed of a single panel 52 itself defining the inner and outer surfaces 48, 50 on opposite sides thereof.

The collar C2 is provided with a circular opening 42, the closure device consisting of a substantially circular disc 22 having a diameter substantially equal to the diameter of the circular opening 42 and being hingedly mounted on the panel 52 to be received with a little clearance within the inlet opening 42 when in the covering or sealing position. In the collar the disc 22 may be provided with an attachment tab 30 which is secured to the panel 52 by any suitable attachment element 54, such as a staple or thread. A straight score line 32 is provided between the attachment tab 30 and the disc 22 to permit hinged movements about the score line.

As with the previous collar C1, the disc 22 can also be die cut in the collar C2, in which case a suitable retainer device 56 must be provided in the region of the projecting tab or finger 36 to lock the position of the disc within the plane of the panel 52 and prevent the disc 22 from inadvertently moving out of the plane of the panel 52 which movements would compromise the sealing action. Such retainer 56 is not critical and any suitable retainer may be used, such as tape.

In the case where the disc 22 is not die cut from the panel 52, it is preferably provided with a diameter which is larger than the diameter of the inlet opening 42, as suggested by the outline 42′ in FIG. 5, so that there is an annular abutment zone 42″ when the disc is in abutment with the panel 52. In order to maintain the abutting relationship between the disc 22 and the panel 52, in the instance when the diameter of the disc is greater than the diameter of the opening, any suitable attachment device 58 (FIG. 6) may be provided at the point of contact between the projecting tab or finger 36 and the outer surface 50. In the embodiment shown in FIGS. 6 and 7, such attachment mechanism may be in the form of mating portions of hook and loop tape 60, 62. While normal adhesive may not be adequate to secure the disc to the panel because contaminated by dust and dirt, numerous attachment devices, such as hook and loop tape, should be satisfactory.

This closure would effectively prevent any appreciable amount of back flow of the air from inside the bag through the opening into which the dirty material had entered the bag, since the porosity of the wall of the filter bag would offer less resistance for air to escape than the flap or disc closed opening in the collar.

This invention is particularly important because many cleaners are used in hospitals and hotels where there is a likelihood of collecting germ contaminated dust which is hazardous to the people who use the vacuum cleaners, and in addition, is extremely unpleasant to the people who have to remove filled bags and replace them with fresh bags.

This construction is additionally very important for vacuum cleaners which pick up hazardous dust, such as asbestos, where it is imperative to contain all the dust collected and prevent it from escaping into the air which has to be breathed by the operators.

In addition to being used on filter bags, this improved tab would also be desireable on bags being filled with powdery materials as a packing operation since the restraint of back flow through the inlet is also important in such packing operations as well as vacuum cleaner bags.

The foregoing is considered illustrative only of the principals of the invention. Further, since numerous modifications and changes will readily occur to those skilled in the art, the invention should not be limited to the exact construction and operations shown and described, and accordingly all suitable modifications and equivalents may be resorted to, falling within the scope of the claims. For example, while the openings 18 and 40, as well as the disc 22 are shown to be substantially circular, it would be appreciated that these can be of any congruent, predetermined configurations consistent with the shape of the inlet fitting of the vacuum cleaner. Also, the embodiment C1 can be formed of two separate panels 12,14 in place of a single panel which is folded about a score line. Additionally, while cutouts 38 are formed in the disc 22, it is also possible to cut-out portions of the outer panel 12 about the periphery of the disc 22, opposite the edge 24 while leaving the disc intact while providing equivalent gripping regions.

I claim:

1. A vacuum cleaner bag, comprising: a collar of rigid or semi-rigid material defining inner and outer surfaces and having an inlet opening of predetermined configuration; a bag attached to said inner surface; cover means having a shape substantially corresponding to said predetermined configuration, said cover means being hingedly mounted for movement between an exposing position in a direction spaced from said outer surface for uncovering said inlet opening and a covering position substantially covering and sealing said inlet opening; and locking means for positively locking said cover means in said covering position, said locking means comprising a projecting finger radially extending from said disk beyond a periphery of said inlet opening, said finger being sufficiently flexible to permit said finger to be resiliently force snapped beyond said inlet opening into locking abutment against said inner surface, whereby said cover means may be maintained in said covering position after the filled vacuum cleaner bag is removed from a vacuum cleaner thereby preventing debris from escaping from said inlet opening.

2. A vacuum cleaner bag as defined in claim 1, wherein said projecting finger is located diametrically opposite to said hinge means.

3. A vacuum cleaner bag as defined in claim 1, wherein substantially equally spaced radial slits are provided about the periphery of said inner opening to produce a plurality of substantially equal-sized radial tabs which can be flexed to selectively enlarge the diameter of said inlet opening for facilitating introduction of a vacuum inlet fitting through said inner opening.

4. A vacuum cleaner bag as defined in claim 1, wherein said collar comprises a single panel having said inner and outer surfaces on opposite sides thereof.

5. A vacuum cleaner bag as defined in claim 1, wherein said collar comprises juxtaposed and joined inner and outer panels, said inner surface being defined by the exposed surface of said inner panel and said outer surface being defined by the exposed surface of said outer panel.

6. A vacuum cleaner bag as defined in claim 5, wherein said inlet opening comprises a circular inner opening in said inner panel and a circular outer opening in said outer panel, said inner opening being concentrically aligned with and being smaller in diameter than said outer opening to form a substantially uniform width annular exposed zone when viewed through said outer opening, said cover means comprising a substantially circular disc having a diameter substantially equal to the diameter of said outer opening and hingedly mounted on said outer panels to be received with little clearance within said outer opening when in said covering position to be in abutment against said annular exposed zone thereby sealing said inner opening.

7. A vacuum cleaner bag as defined in claim 6, hinge means being provided for hingedly mounting said cover means and being in the form of a hinge strip die cut in said outer panel and connected at one end to said disc and connected at an opposing end to said outer panel at a transverse straight score line.

8. A vacuum cleaner bag as defined in claim 6, wherein said inner and outer panels are formed from a blank with a score line about which said panels can be folded one into abutment against the other; and connecting means for maintaining said panels joined to each other.

9. A vacuum cleaner bag as defined in claim 6, further comprising at least one enlarged region of increased spacing between said outer opening and said disc to facilitate gripping of said disc when received within said outer opening for movement to said exposing position.

10. A vacuum cleaner bag as defined in claim 9, wherein said enlarged region is formed by a cutout in one of said disc and outer panel in the region of said outer opening.

11. A vacuum cleaner bag as defined in claim 10, wherein hinge means is provided for hingedly mounting said cover means; two cutouts being provided on said disc on opposite sides if a plane normal to said disc and passing through said hinge means.

* * * * *